United States Patent [19]

Deslauriérs

[11] 4,171,774

[45] Oct. 23, 1979

[54] EXPANSION JOINT FOR RAILROAD TRACKS

[76] Inventor: Alphege P. Deslauriérs, 98 Brunelle Rd. South, Kapuskasing, Ontario, Canada, P5N 2T5

[21] Appl. No.: 846,828

[22] Filed: Oct. 31, 1977

[30] Foreign Application Priority Data

Sep. 14, 1977 [CA] Canada ..... 286682

[51] Int. Cl.[2] ..... E01B 11/26

[52] U.S. Cl. ..... 238/171; 238/230; 238/319

[58] Field of Search ..... 238/151, 171, 172, 173, 238/209, 216, 230, 231, 232, 319

[56] References Cited

U.S. PATENT DOCUMENTS

| | | | |
|---|---|---|---|
| 966,087 | 8/1910 | Chebut | 238/319 |
| 1,022,786 | 4/1912 | Iring | 238/319 |

FOREIGN PATENT DOCUMENTS

| | | | |
|---|---|---|---|
| 830964 | 1/1952 | Fed. Rep. of Germany | 238/230 |
| 612051 | 11/1960 | Italy | 238/151 |

OTHER PUBLICATIONS

A.P.C. Application of Cipolla, Ser. No. 401,901, Published May 25, 1943.

*Primary Examiner*—Trygve M. Blix
*Assistant Examiner*—Ross Weaver
*Attorney, Agent, or Firm*—Larson, Taylor and Hinds

[57] ABSTRACT

The specification describes an improved railroad track expansion joint which is comprised of a pair of longitudinally aligned elongated joint members interconnected with one another by means of a dovetail joint formed along abutting faces which extend at an acute angle to the members. The other ends of the joint members are connected to conventional rails and any expansion and contraction of the rails will cause the members to slide relative one another along the abutting face.

10 Claims, 5 Drawing Figures

EXPANSION JOINT FOR RAILROAD TRACKS

This invention relates to railroad track expansion joints.

For many decades, the railroad industry has been faced with the problem of elongation and contraction of rail tracks. Relatively small temperature fluctuations may result in significant track length fluctuations. To compensate for track length fluctuations, it is conventional to periodically space track lengths such that during hottest expected temperatures, the ends of the tracks just meet. If insufficient longitudinal separation is provided, excessive elongation may cause the tracks to buckle. Under normal conditions and especially during cooler periods, the separations generate vibration in the trains and cause passenger discomfort and wear of train parts. Various solutions to this problem have been proposed but none have evidently been successful. Prior solutions have tended to be rather complex and have therefore not been financially feasible.

The present invention provides a railroad track expansion joint which is simple in construction and manufacture and which provides a continuous or uninterrupted surface upon which the train wheels may roll.

The invention may be broadly described as a railroad track expansion joint comprising first and second elongated joint members each of which have one end adapted to be secured to the end of a conventional railroad track. The joint members are formed with mating abutting faces at their other ends which extend at an acute angle with respect to the length of the members. One of the faces is formed with a tongue means which extends along the length of the face and parallel thereto, while the other of the faces is formed with a groove means which extends along the length of the other face and parallel thereto and receives the tongue means whereby expansion or contraction of the track will cause the tongue and groove means to slide relative to one another.

These and other advantages of the invention will become more apparent from the description which follows in which reference is made to the accompanying drawings, wherein.

Figure 1:
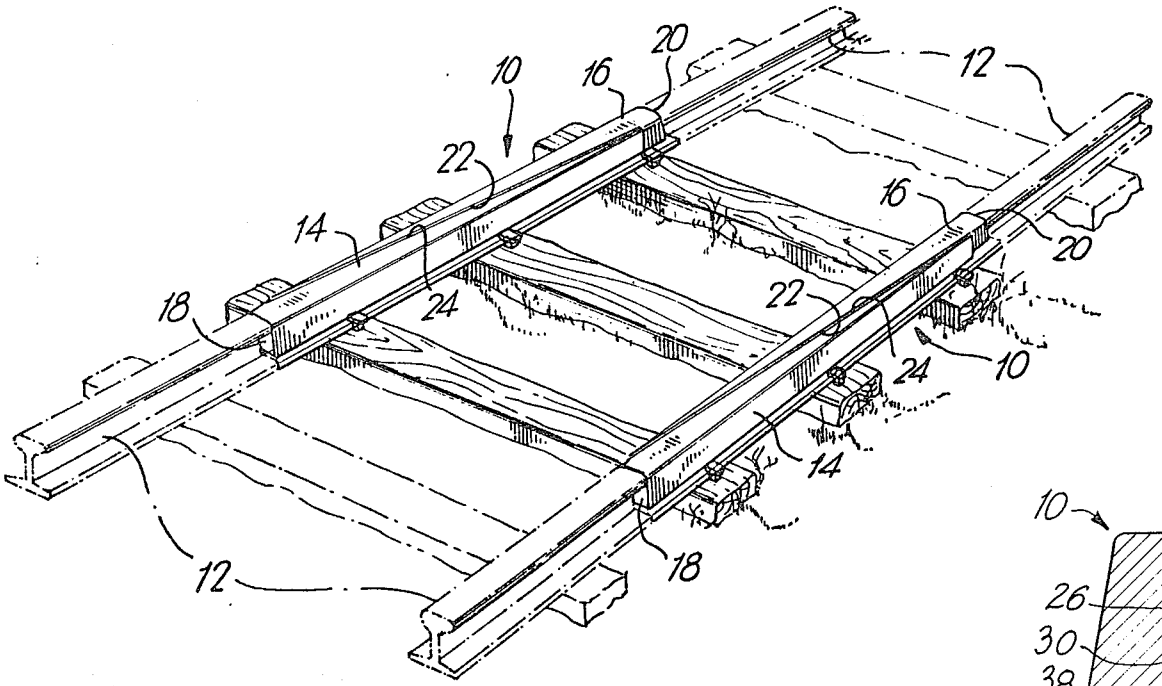
FIG. 1 is a perspective view illustrating the expansion joint.

With reference to FIG. 1, expansion joints 10 are shown interconnecting the ends of conventional railroad tracks 12. Each joint 10 includes a pair of elongated joint members 14 and 16 having their ends 18 and 20, respectively, connected, as by welding or any other suitable means, to the adjacent end of a conventional track.

Figure 5:
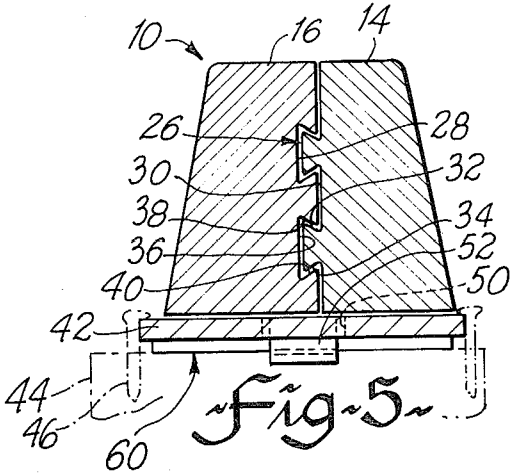
FIG. 5 is a cross-sectional view of a joint taken along line 5—5 of FIG. 2.
Figure 2:
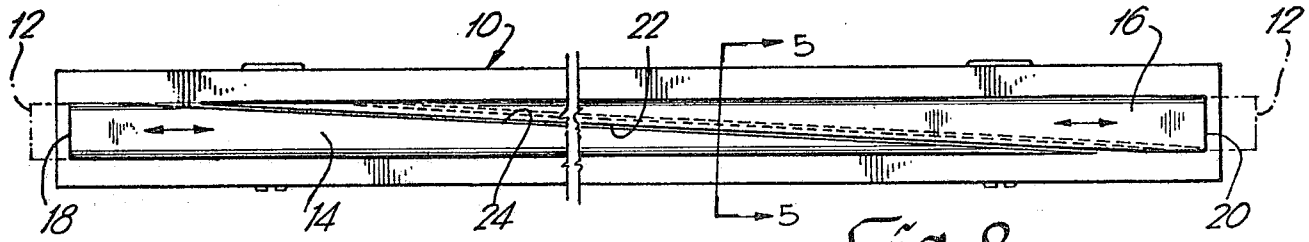
FIG. 2 is a top view of a joint interconnecting the ends of conventional track.
Figure 3:
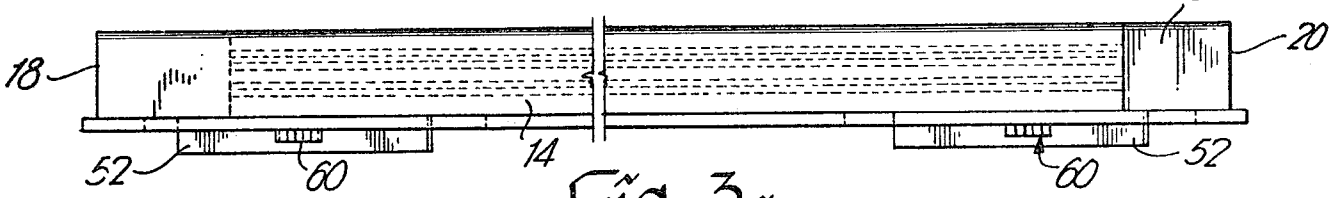
FIG. 3 is an elevational view of a joint.
Figure 4:
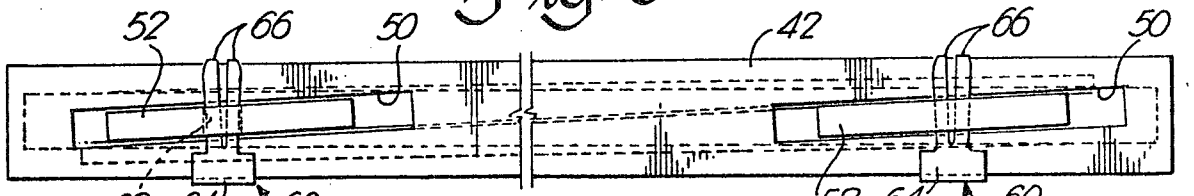
FIG. 4 is a bottom view of a joint.

The other ends of the joint members 14 and 16 are formed with mating abutting surfaces 22 and 24 which extend at an acute angle to the length of the members or tracks and which are adapted to slide relative to one another during expansion or contraction. As best shown in FIG. 5, one of the abutting faces is formed with a tongue means 26 while the other of the faces is formed with a mating groove means 28 adapted to receive the tongue means so as to form a dovetail joint, guide the two members during expansion and contraction and prevent lateral or transverse separation thereof. More specifically the tongue and groove means are trapezium-shaped and are sized to provide free sliding movement relative to one another during the hottest temperatures to be encountered.

In FIG. 5, two tongues 26 are shown on member 14 each having a vertical face 30 and a pair of outwardly diverging inclined faces 32 and 34. Similarly, two grooves 28 are shown in member 16, each having an internal vertical face 36 and a pair of converging inclined faces 38 and 40.

Means may also be provided for supporting the joint over a plurality of conventional ties, defining permissable limits of expansion and contraction, absorbing excessive transverse, longitudinal loads due to expansion and distributing expansion and contraction loads as between several joints. To this end, an elongated plate 42 is positioned immediately beneath a joint 10 and spans several ties 44. Each plate 42 is secured to the ties by means of conventional spikes 46.

Plates 42 are formed with a pair of longitudinally spaced slots 50 which extend at an acute angle with respect to the length of the plates, which angle is the same as that of the abutting faces. Each member 14 and 16 is formed with a downwardly depending lug 52 which extends into and through a slot 50 in adjacent plate 42. The length of the lug 52 is less that of the slot by amount equal to the designed or allowable expansion and the width of the lug will be less than that of the slot by an amount equal to the transverse displacement accompanying maximum longitudinal movement.

The lugs are maintained operatively positioned within the slot by means of a retainer 60 which extends through an appropriate transverse hole 62 in lug 52. In a preferred form, retainer 60 is formed with a head 64 and a pair of unitary spring arms 66 which are adapted to resiliently move towards or away from one another during assembly and disassembly. However, any other suitable means may be provided to retain lugs 52 operatively positioned within slots 50.

It will be appreciated that the angle between the abutting faces 14 and 16 and the length of the members should be as small as possible to minimize the accompanying lateral displacement of the members. Furthermore, the clearance between the tongues and grooves must be sufficient to permit relative lateral movement of the members and prevent binding of the joint so as not to subject the members to unduly high stresses. It has been found that an angle in the neighbourhood of 2 to 10 degrees and, preferrably 6 degrees, are satisfactory.

It will be appreciated that each face 22 and 24 may be formed with a plurality of grooves or tongues or a combination thereof.

It will also be appreciated that the joint members may be easily manufactured by conventional molding processes and the abutting sliding surfaces subsequently appropriately finished by conventional surface finish techniques.

It will be seen therefore that the present railroad track expansion joint is of simple construction and manufacture and provides a continuous and uninterrupted surface thereby resulting in improved train passenger comfort and safety.

The embodiments of the invention in which an exclusive property or privilege is claimed are defined as follows:

1. A railroad track expansion joint comprising: first and second elongated joint members each having one end adapted to be secured to the end of a conventional railroad track, said joint members having mating abutting faces at their other ends, said faces extending at an acute angle with respect to the length of said members, one of said faces being formed with a tongue means extending along the length of said face and parallel thereto, the other of said faces being formed with a groove means extending along the length of said other face and parallel thereto and receiving said tongue means whereby expansion or contraction of said track will cause said tongue and groove means to slide relative to one another, plate means adapted to be positioned between said joint members and supporting ties and providing a surface upon which said members may slide, said plate means having a pair of elongated slots extending at an angle to the length of said plate equal to and at the same attitude of said acute angle, each said members having a lug adapted to extend into one of said slots and having a smaller length than that of said slot by an amount equal to a predetermined amount of permissible expansion or contraction.

2. A railroad track expansion joint as defined in claim 1, said one face having two parallel and coextensive tongue means and said other face having two parallel and coextensive groove means for matingly receiving said tongue means.

3. A railroad track expansion joint as defined in claim 1, each said face having a tongue means and a groove means.

4. A railroad track expansion joint as defined in claim 1, said tongue means and groove means forming a dovetail connection.

5. A railroad track expansion joint as defined in claim 1, said angle being between 3 and 20 degrees.

6. A railroad track expansion joint as defined in claim 1, said angle being between 3 and 10 degrees.

7. A railroad track expansion joint as defined in claim 1, said angle being 6 degrees.

8. A railroad track expansion joint as defined in claim 1, said projection extending parallel to said abutting faces.

9. A railroad track expansion joint as defined in claim 8, further including a retaining means removably secured to said projection for preventing separation of said members and plate.

10. A railroad track expansion joint as defined in claim 9, said retaining means comprising a head portion and a pair of resilient arms adapted to extend through a transverse hole in said lugs on the side of said plate remote from said members.

* * * * *